United States Patent [19]

Pringle

[11] 3,941,411

[45] Mar. 2, 1976

[54] DOOR LOCK ASSEMBLY

[75] Inventor: William L. Pringle, Grosse Pointe Shores, Mich.

[73] Assignee: United States Steel Corporation, Pittsburgh, Pa.

[22] Filed: Oct. 29, 1974

[21] Appl. No.: 518,259

[52] U.S. Cl. ..... 292/26; 292/97; 292/336.3

[51] Int. Cl.[2] ..... E05C 9/16

[58] Field of Search ..... 292/26, 29, 30, 48, 52, 292/53, 216, 97, 280, 336.3, DIG. 23, DIG. 24, DIG. 26, DIG. 27

[56] References Cited

UNITED STATES PATENTS

| | | | |
|---|---|---|---|
| 1,651,724 | 12/1927 | Morgan | 292/DIG. 23 X |
| 2,582,927 | 1/1952 | Dall | 292/52 |
| 2,693,099 | 11/1954 | Vigmostad | 292/26 X |
| 2,877,043 | 3/1959 | Leslie | 292/280 |
| 3,140,888 | 7/1964 | DiSalvo | 292/48 |
| 3,561,807 | 2/1971 | Ploughman | 292/216 |
| 3,608,941 | 9/1971 | Kondo et al. | 292/DIG. 26 X |
| 3,666,305 | 5/1972 | Schlichter | 292/48 |
| 3,784,241 | 1/1974 | Pickles | 292/48 X |
| 3,826,520 | 7/1974 | Ross et al. | 292/30 |
| 3,844,593 | 10/1974 | Slattery | 292/216 X |

FOREIGN PATENTS OR APPLICATIONS

| | | | |
|---|---|---|---|
| 1,033,543 | 7/1958 | Germany | 292/30 |

*Primary Examiner*—Roy D. Frazier
*Assistant Examiner*—Thomas J. Holko
*Attorney, Agent, or Firm*—McGlynn and Milton

[57] ABSTRACT

A door latch assembly operable from at least two remote positions including a pair of opposed latch arms pivotally supported by a latch bracket for engaging a latch bar, a movable link connected to the latch arms for pivoting the latch arms alternately toward a latched and unlatched position, a release lever for actuating the link to pivot the latch arms toward the unlatched position, and means for supporting the release lever, preferably a ball and socket connection, for movably supporting the release lever in engaging proximity to the link such that the release lever in engaging proximity to the link such that the release lever is movable about at least two angularly related axes.

29 Claims, 9 Drawing Figures

DOOR LOCK ASSEMBLY

This invention relates to closure fasteners and is particularly adapted for use in vehicle applications such as automobiles and trucks.

In vehicle applications, the latching mechanism for the doors must be operable from at least two locations relatively remote from the mechanism itself. In other words, the door handles for operating the latching mechanism are normally located some distance from the latching mechanism. In most cases, the outside door handle is located above the latching mechanism and the inside door handle is located laterally from the latching mechanism toward the hinged side of the door. Therefore, an immediate requirement for any vehicle door latch mechanism is the capability of operating the same from two remote locations spaced generally vertically and horizontally from the latching mechanism.

All vehicle latching mechanisms also include a locking device for disabling the latching mechanism to prevent inadvertent or unauthorized opening of the door. The well-known push-button is the standard actuator for such locking devices. In recent years, locking devices have been designed so that, when the vehicle door is open and the push-button moved to the locked position, the door will be locked when subsequently closed. In other words, it is unnecessary to manipulate the outside door handle to keep the locking device engaged to cause locking of the door. This is another required feature of vehicle door latching mechanisms. More specifically, the latching mechanism must include a locking device which is operable substantially independently of the position of other elements of the latching mechanism.

Moreover, the vehicle door-latching mechanism must positively latch the door to the door frame to prevent the door from opening in the event of a collision, rollover, or other type of accident. In some vehicle door-latching mechanisms currently employed, the forces developed between the latch bar and the latch mechanism during an accident oftentimes urge the latch mechanism toward the unlatched position. If the forces are great enough, the door will open. This of course is an undesirable result at best.

The instant invention provides an improved door latch assembly particularly suited for vehicle doors which is operable from two relatively remote locations. Accordingly, the instant invention includes latch means for engaging a latch bar. The latch means is pivotally supported by support means, such as a latch bracket. A movable link means is connected to the latch means for moving the latch means alternately toward a latched and unlatched position. That is, the movable link moves the latch means toward the latched position in response to the engagement thereof by a latch bar and toward the unlatched position in response to the engagement thereof by a release lever. The release lever includes support means for pivotally and rotatably supporting the release lever in engaging proximity to the link means such that the release lever is movable about at least two angularly related axes. For example, referring to the standard three axis spacial co-ordinate system, the release lever is supported by the support means for pivotal movement about a vertical axis and rotatable movement about one of the horizontal axes. The release lever can, therefore, be operated from locations spaced vertically and laterally from the latch mechanism.

The invention also includes a lock lever which is movable into a position to prevent actuation of the link means by the release lever thereby precluding movement of the latch means toward the unlatched position. The lock lever functions relatively independently of the other elements of the latch mechanism. Therefore, once the lock lever is moved to the locked position by the standard push-button actuator, there is no need to manipulate the outside door handle to insure locking of the door.

Moreover, the latching mechanism effects a substantially positive engagement with the latch bar which resists movement toward the unlatched position when a force tending to open the door is applied.

Other advantages of the present invention will be readily appreciated as the same becomes better understood by reference to the following detailed description when considered in connection with the acompanying drawings wherein.

Figure 1:
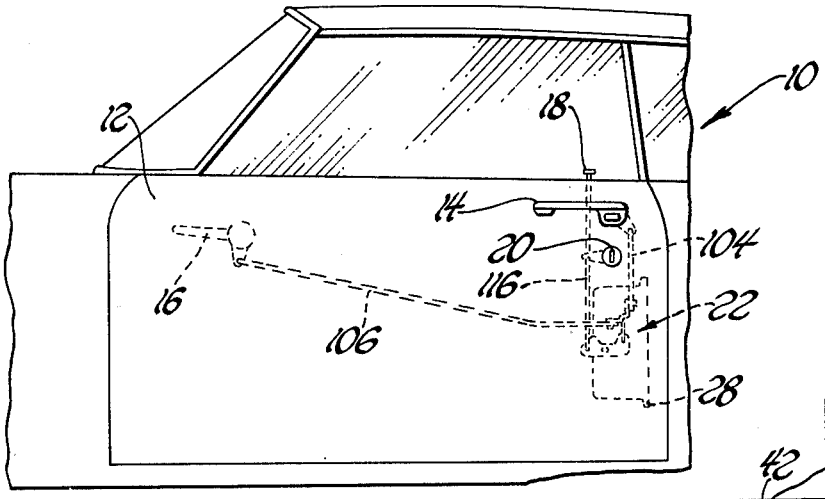
FIG. 1 is a broken-away view of a vehicle including a door having a latching mechanism constructed in accordance with the instant invention and controls for operating the latching mechanism.

Referring to the drawings, and particularly to FIG. 1, a portion of a vehicle, in this case an automobile, is generally shown at 10. The vehicle includes a vehicle door 12 having the normally provided outside handle 14, inside handle 16, door lock push-button 18, and key-operated cylinder lock 20. These elements are all of standard design and construction and, therefore, require no detailed description. Suffice it to say, however, that the elements include motion transmitting levers actuated by the respective element which are attached to control rods that will be more clearly described hereinafter. A door latch assembly, generally shown at 22, is mounted on the door 12 for latching the door in the closed position.

The door latch assembly 22 includes support means, generally indicated at 24, comprising an open-sided box-like latch bracket 26. The latch bracket 26 includes a mounting flange 28 for securing the same to an interior surface of the door 12 by suitable fasteners. As will become apparent by the following description, the latch bracket 26 supports the various other elements of the door latch assembly 22.

Figure 4:
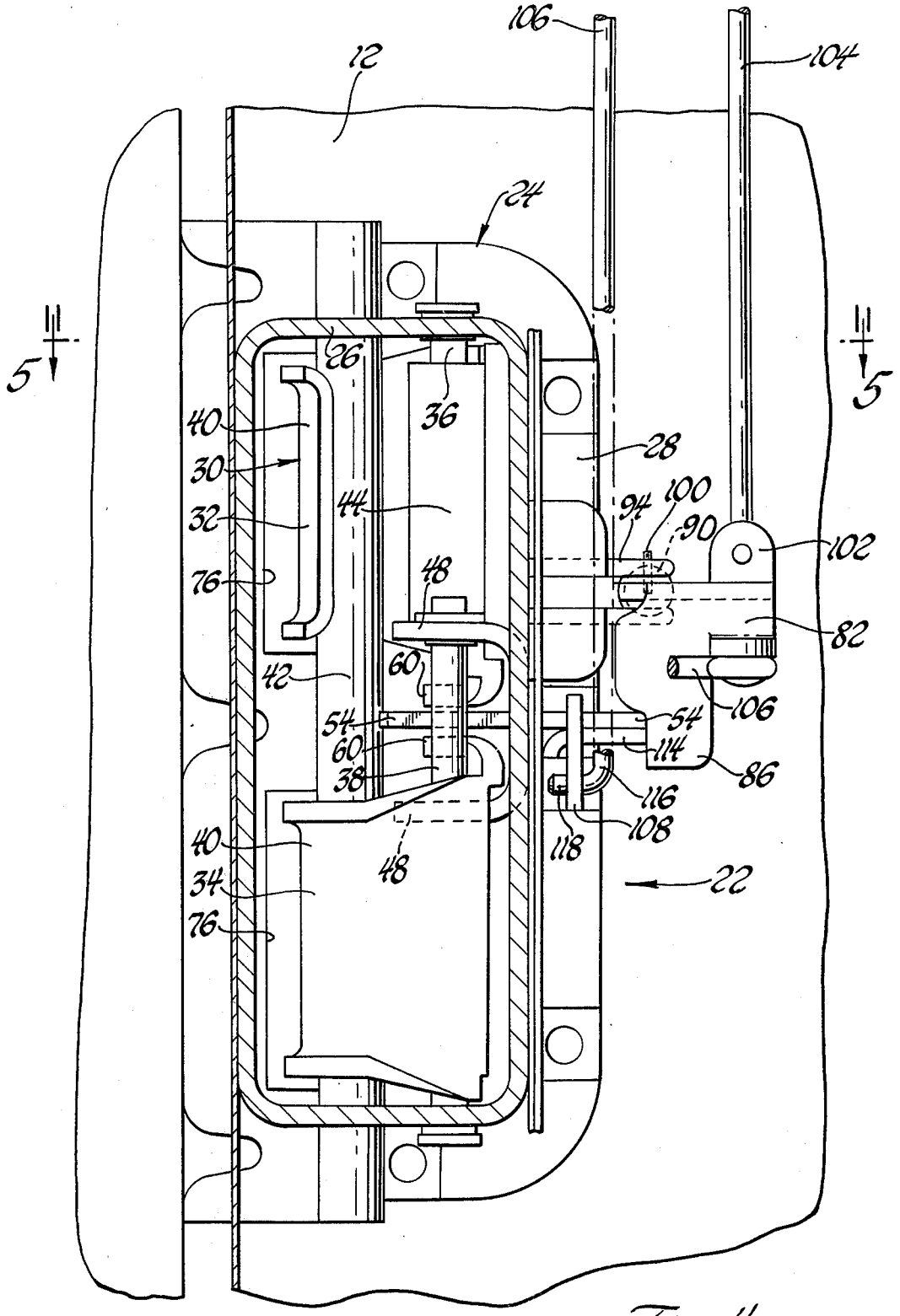
FIG. 4 is a longitudinal cross-sectional view taken generally along line 4—4 of FIG. 2.
Figure 9:
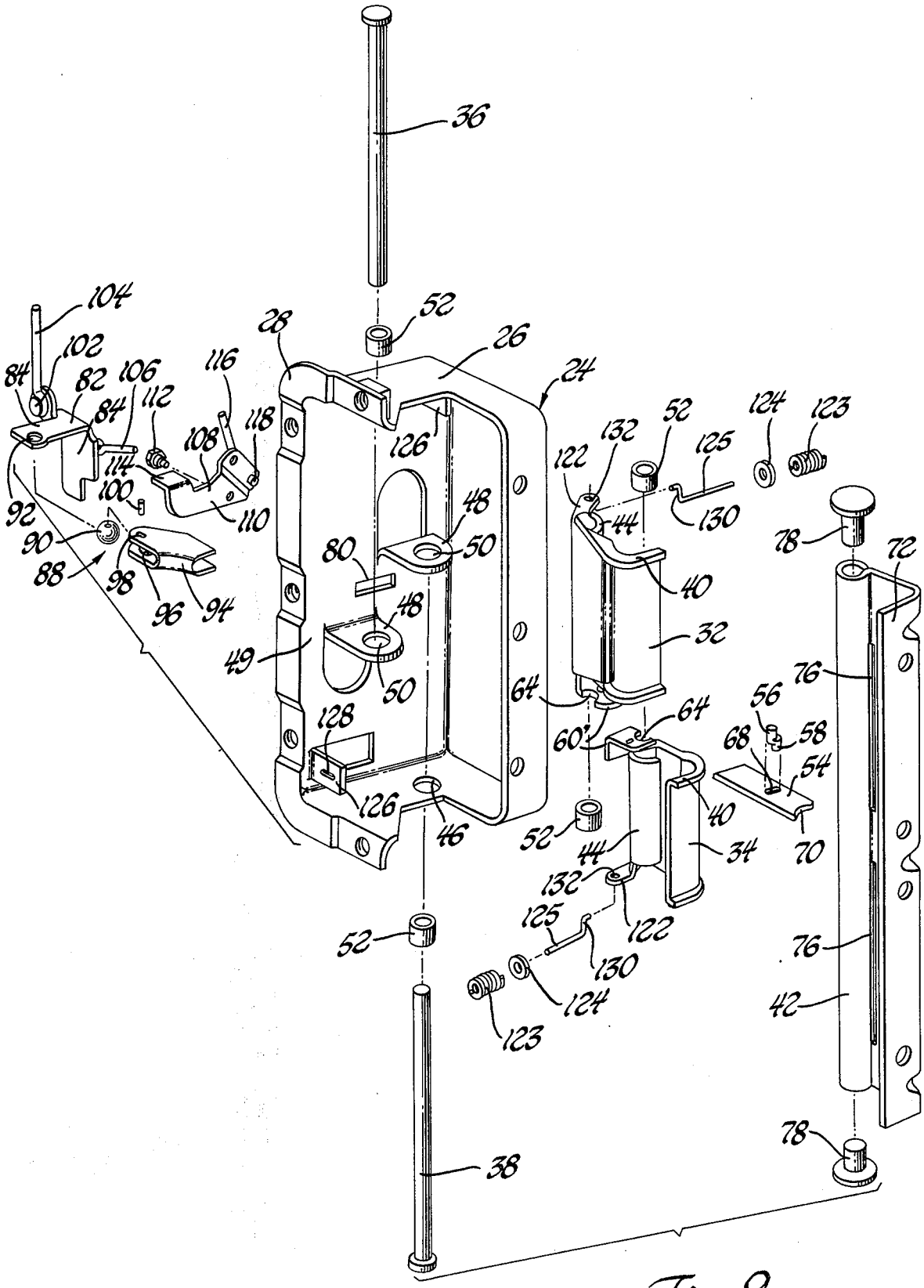
FIG. 9 is an exploded view of the instant invention including a slight modification.

More specifically, and referring to FIGS. 4 and 9, latch means generally indicated at 30, comprising a pair of opposed latch arms 32 and 34, is pivotally supported by the latch bracket 26 on latch pivot pins 36 and 38. Each of the latch arms 32 and 34 includes a hook portion 40 for partially wrapping around a latch bar 42. The latch arms 32 and 34 also include a wrapped portion 44 for defining a cylindrical sleeve which receives the latch pivot pins 36 and 38.

Figure 5:
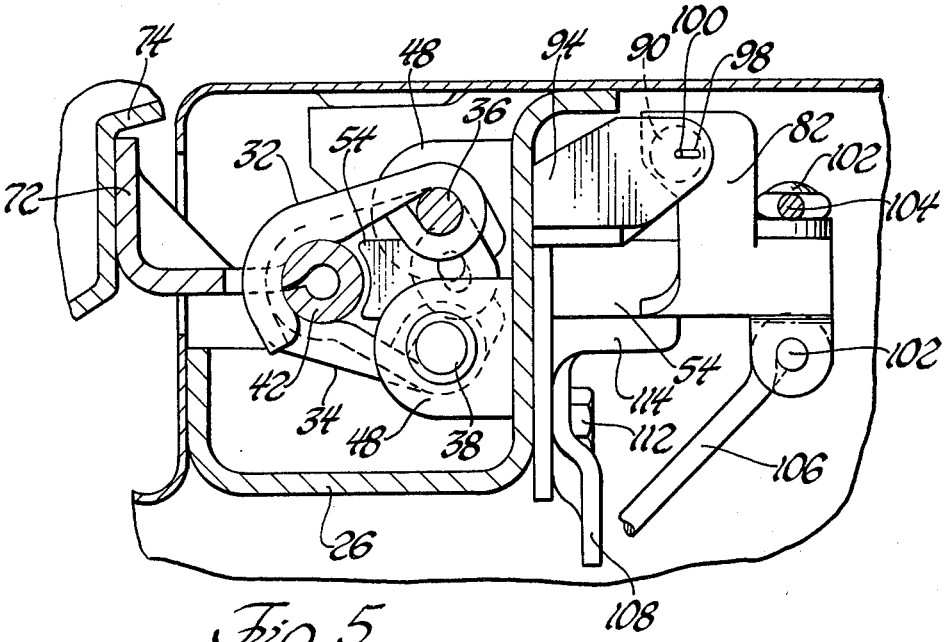
FIG. 5 is a transverse cross-sectional view taken generally along 5—5 of FIG. 4.

The latch bracket 26 includes a hole 46 in each end wall thereof. Aligned with, and spaced from, each of the holes 46 is a struck-out portion 48 on a sidewall 49, each having a hole 50 therein. Each hole 46 cooperates with its aligned struck-out portion 48 to receive and support one of the latch pivot pins 36 and 38. Retainer bushings 52 are provided for maintaining the latch pivot pins 36 and 38 in place. It is noted that the latch pivot pins 36 and 38 are supported such that they are relatively displaced in the direction of their longitudinal axes and also laterally thereof. Consequently, the latch arms 32 and 34 are supported one above the other and relatively laterally displaced. The over-under positioning accomplished by this arrangement permits the opposed latch arms 32 and 34 to overlap and partially encircle the latch bar 42 in the latched position, as best shown in FIG. 5.

Figure 6:
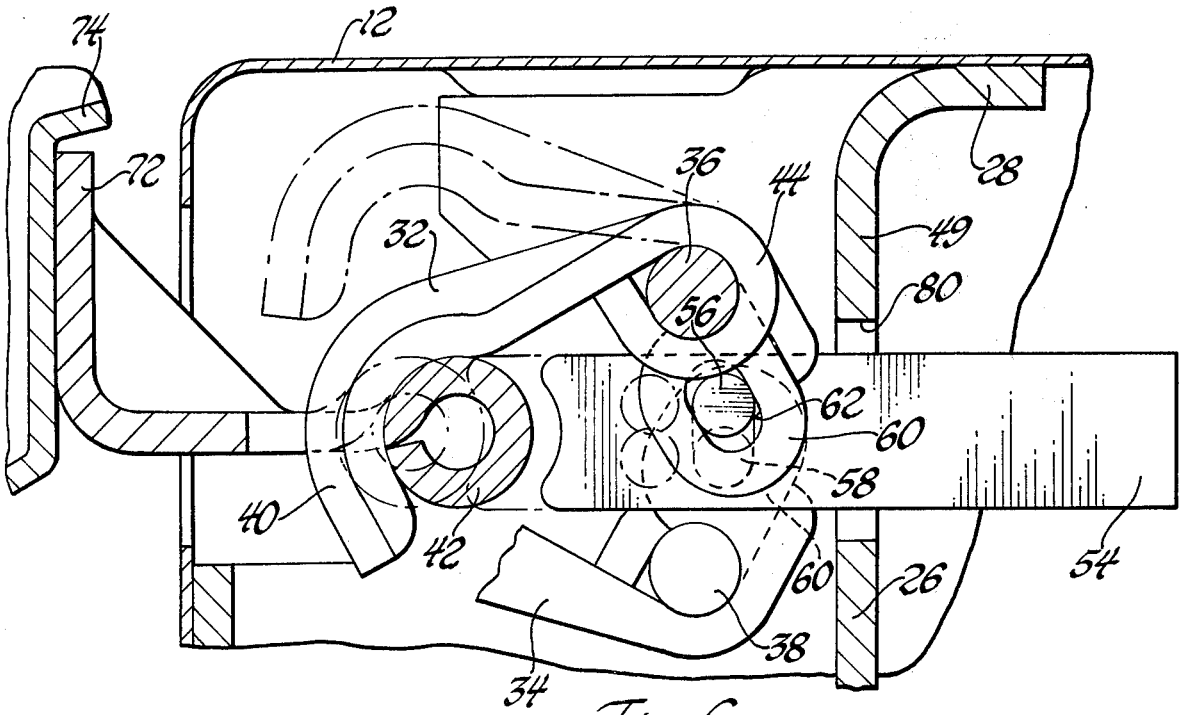
FIG. 6 is an enlarged, broken-away view similar to FIG. 5 showing the interrelated movement of various elements.

The door latch assembly 22 further includes link means comprising a latch bar striker 54 disposed between the latch arms 32 and 34 for moving the latch arms between the latched and unlatched positions. The latch bar striker 54 includes a pair of posts 56 and 58, one extending from each side thereof, for engaging a lever arm 60 or 60′ on the latch arms 32 and 34. As shown in FIGS. 5 and 6, the lever arms 60 are generally elliptically-shaped projections extending from the latch arms which include an elongated slot 62 of sufficient size to receive one of the posts 56 and 58. In the embodiment shown in FIG. 9, the lever arms 60′ are generally rectangularly shaped projections extending from the latch arms. Each of the lever arms 60′ includes a semi-circular opening 64 for receiving one of the posts 56 and 58.

Figure 7:
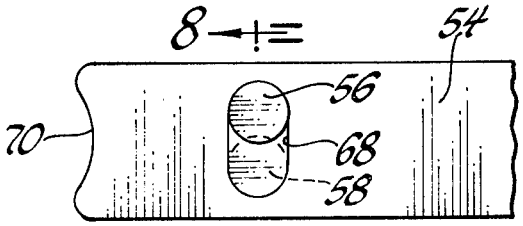
FIG. 7 is a broken-away plan view of an element of the instant invention.
Figure 8:
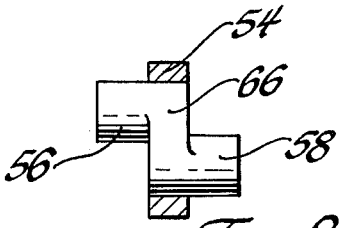
FIG. 8 is a transverse cross-sectional view taken generally along line 4—4 of FIG. 2.

As shown in FIG. 7 through 9, the posts 56 and 58 are formed integrally with an elliptically-shaped base 66 which seats in an elongated slot 68 in the latch bar striker 54. The outer end of the latch bar striker 54 includes a concave surface 70 having a radius similar to that of the latch bar 42.

The latch bar 42 includes attachment means 72 comprising a flange for attaching the same to the door frame 74 of the vehicle. As shown in FIG. 9, the latch bar 42 is of a one-piece design wherein a rolled portion forms the bar 42 and the remaining material is bent to form the attaching flange 72. Rectangular openings 76 are provided adjacent the rolled portion to receive the ends of the latch arms 32 and 34. End caps 78 may be disposed in the open ends of the rolled portion to cover the same.

The inner end of the latch bar striker 54 extends through an opening 80 in the side wall 49 of the latch bracket 26 so that it may be engaged by a release lever 82. The release lever 82 is adapted to move the latch bar striker 54 and, consequently, the latch arms 32 and 34 toward the unlatched position to release the latch bar 42.

The release lever 82 is a generally L-shaped member which includes a base portion 84 having first and second ends and a finger portion 86 located adjacent the second end and extending angularly from the base portion 84. The release lever support means generally shown at 88 in FIG. 9 is provided for pivotally and rotatably supporting the release lever 82 in engaging proximity to the latch bar striker 54. The release lever support means includes a ball member 90 which is rigidly secured to the first end of the release lever 82 in a suitable opening 92. A ball seat member 94 is attached to the back of side wall 49 and includes two parallel, spaced-apart plates, the facing surfaces of which have concave depressions 96 for receiving the ball member 90.

With the ball and socket arrangement thus described, the release lever 82 is substantially free to pivot or rotate in a universal fashion. To prevent binding or jamming of the release lever 82, it is desirable to limit the movement of the release lever 82 to two specific axes. Accordingly, an elongated slot 98 is located in one plate of the ball seat member 94 which communicates with the concave depression. A pin 100 is disposed in a hole in the ball member 90 and extends through the slot 98. Consequently, the release lever 82 is capable of pivoting about a vertical axis and rotatably about a longitudinal axis extending horizontally through the base portion 84. For pivoting about the vertical axis the pin 100 is the center of rotation, while for rotating about the longitudinal axis of the base portion 84, the pin 100 moves in the slot 98. The release lever 82, however, is precluded from pivoting about an axis extending transversely of the base portion 84, that is, in a vertical direction, since the pin 100 is confined by the slot 98.

To describe the operation of the elements thus far described, reference is made to FIGS. 4 through 6. In the unlatched position the latch arms 32 and 34 are pivoted away from one another. (The unlatched position of the latch arm 32 and the position of the latch bar striker 54 are shown in phantom in FIG. 6.) As the door 12 is moved toward the closed position, the latch bar 42 approaches and engages the latch bar striker 54 thus moving it rearwardly, or to the right, as shown in FIGS. 5 and 6. Due to the connection between the latch bar striker 54 and the lever arms 60, a torsional force is applied to the wrapped portions 44 thereby causing the latch arms 32 and 34 to pivot toward one another and engage the latch bar 42. (The latched positon of the latch arm 32 and the position of the latch bar striker 54 are shown in full lines in FIG 6.)

Since, in the latched position, the hooked portions 40 of the latch arms 32 and 34 wrap around the latch bar 42, any force tending to pull the latch bar 42 away from the latch arms 32 and 34 increases the gripping action of the latch arms. Consequently, a positive latching action is produced by the door latch assembly.

To release the latch bar 42, the release lever 82 is actuated. Actuation of the release lever 82 moves the latch bar striker 54 forwardly, or to the left, as viewed in FIGS. 5 and 6. In the latched position there is a gap or space between the outer end of the latch bar striker 54 and the latch bar 42. Initial movement of the latch bar striker 54, therefore, begins to pivot the latch arms 32 and 34 away from one another before the latch bar striker 54 engages the latch bar 42. Without the gap, that is, if the latch bar striker directly engages the latch bar, the latch arms 32 and 34 could not be disengaged due to a force exerted thereon by the latch bar 42 to the latch bar striker 54. Therefore, initial movement of the latch arms toward the unlatched position is necessary before contact is made with the latch bar 42 by the latch bar striker 54.

The release lever 82 includes attachment means 102 for attaching a pair of control rods 104 and 106 thereto. It is noted that the attachment means 102, in this case rivets, are located at positions spaced laterally from the axis about which the attached control rod is adapted to move the release lever 82. The lateral spacing produces a torsional force or moment which is necessary to cause the release lever 82 to pivot or rotate.

One of the control rods 104 is connected to the outside handle 14 such that manipulation of the handle 14 causes the control rod 104 to move downwardly. This is accomplished by a standard link-operated lever. As best shown in FIG. 4, downward movement of the control rod 104 rotates the release lever 82 in a clockwise direction about ball member 90 thereby causing the finger portion 86 to move the latch bar striker 54 to the left. As described above, movement of the latch bar striker 54 causes movement of the latch arms 32 and 34 toward the unlatched position.

Figure 2:
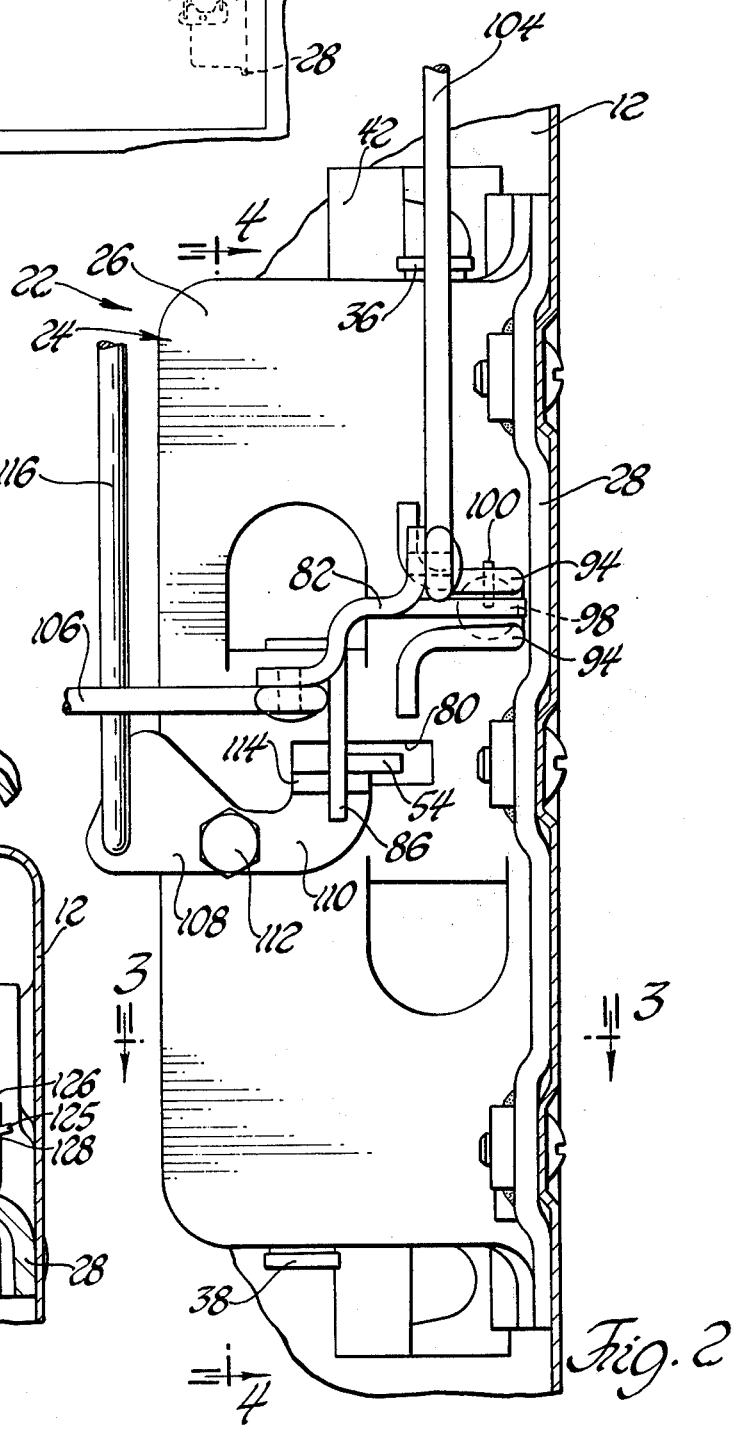
FIG. 2 is an elevational view of the instant invention broken away from a support structure.

The second control rod 106 is connected to the inside handle 16 such that manipulation of the handle 16 causes the control rod 106 to move to the left as viewed in FIG. 1. This is also accomplished by a standard link-operated lever. As best shown in FIG. 2, movement of the second control rod 106 to the left causes rotation of the release lever 82 about the pin 100 thereby causing the finger portion 86 of the release lever 82 to move the latch bar striker 54 outwardly, that is, toward the latch bar 42. As described above, such movement of the latch bar striker 54 pivots the latch arms 32 and 34 toward the unlatched position. The latch mechanism may thus be operated from either of two remote locations through the release lever 82.

In order to lock the door latching assembly in the latched position, that is, in order to lock the door, the assembly is provided with a lock arm 108. The lock arm 108 is movable to a position to prevent pivotal or rotatable movement of the release lever 82. The lock arm 108 includes a body portion 110 which is pivotally connected to the rear surface of the side wall 49 of the latch bracket 26 by a suitable fastener 112. The lock arm 108 further includes a flange portion 114 supported by the body portion 110 at a position displaced from the pivot axis thereof. The flange portion 114 extends generally in a direction parallel to the pivot axis of the body portion 110 such that it may be brought into side-by-side relationship with the latch bar striker 54, as best shown in FIG. 4.

The lock arm 108 further includes attachment means for attaching a lock control rod 116 thereto. The attachment means comprises an aperture for receiving a bent section 118 of the lock control rod. The end of the bent section 118 may be peened over to provide a relatively permanent connection with the lock arm. As shown in FIG. 1, the control rod 116 is connected to the door lock push-button 18 and the key-operated cylinder lock 20. Upward movement of the control rod 16, which is effected by pulling upwardly on the push-button 18 or turning the key in the lock 20, rotates the lock arm 108 in a counterclockwise direction. Such rotation moves the flange 114 downwardly and away from the finger portion 86 of the release lever 82 thereby permitting movement of the release lever 82. Reversing this step, that is, moving the lock control rod 116 downwardly, rotates the flange 114 into interferring engagement with the release lever 82. It is particularly pointed out that when the door is opened, and the latch bar striker 54 is in the forward, unlatched position, the lock arm 108 may be rotated into locking position. When the door is closed, the latch bar striker 54 merely slides by the flange 114 on the lock arm 108. In other words, the lock arm 108 acts independently of the other elements of the door latch assembly so that additional manipulation of the outside door handle is unnecessary.

Figure 3:
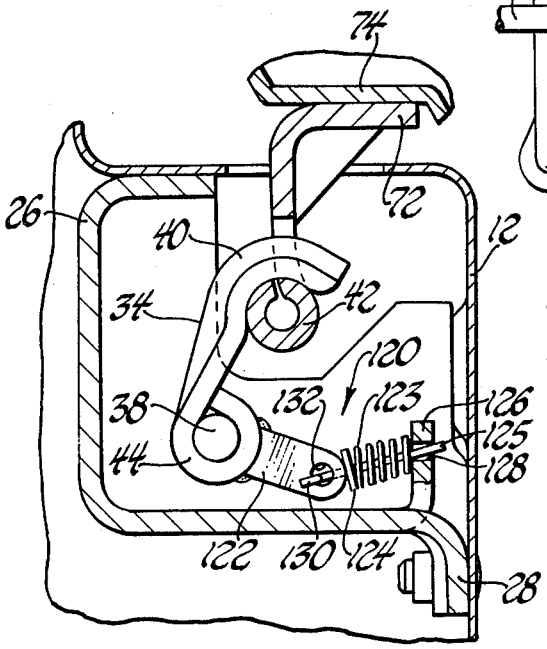
FIG. 3 is a transverse cross-sectional view taken generally along line 3—3 of FIG. 2.

Each of the latch arms 32 and 34 may also be provided with over-center spring means generally shown at 120 in FIG. 3. The over-center spring means urges the latch arms toward either the latched or unlatched positions. In other words, after the latch arm striker 54 has rotated the latch arms 32 and 34 partially toward the unlatched position, the over-center spring device forces the latch arms 32 and 34 the remaining distance to the unlatched position. Furthermore, the over-center spring device holds the latch arms 32 and 34 in either the latched or unlatched position until the arms are acted upon by the latch bar striker 54. Conversely, when the door is being closed, it is only necessary for the latch bar 42 to move the latch bar striker 54 a short distance before the over-center spring device 120 begins to urge the latch arms 32 and 34 the rest of the distance to the latched position.

The over-center spring device employed in the instant invention includes a lever arm 122 attached near the outer ends of the latch arms 32 and 34. A spring 123 and washer 124 are supported on a rod 125 which extends between the lever 122 and a struck-out tab 126 in the side wall 49 of the latch bracket 26. The struck-out tab 126 includes an aperture 128 for receiving the end of the rod 125. The rod 125 includes an L-shaped portion 130 which is positioned in a hole 132 in the lever 122 to retain the rod 125 therein.

The over-center spring device 120 acts in the standard fashion. That is, the spring urges rotation of the latch arm in a first direction until the latch arm is rotated past a center-point at which the spring urges the latch arm in the opposite direction. It is noted that other types of over-center spring devices may be employed with equivalent results.

Moreover, it is contemplated that the latch bar 42 and latch arms 32 and 34 may be coated with a sound dampening material such as rubber, or the like, to prevent rattles.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

I claim:

1. A door latch assembly comprising: support means; latch means for engaging a latch bar, said latch means being pivotally supported by said support means; movable link means connected to said latch means for pivoting said latch means alternately toward a latched position and an unlatched position; a release lever for actuating said link means to pivot said latch means toward the unlatched position; and release lever support means for movably supporting said release lever about at least two angularly related axes in engaging proximity to said link means such that said release lever is movable about each said axis to effect pivoting of said latch means.

2. An assembly as set forth in claim 1 wherein said release lever includes a base portion having first and second ends, said release lever support means being located adjacent the first end, a finger portion located adjacent the second end and extending angularly from said base portion.

3. An assembly as set forth in claim 2 wherein said release lever includes attachment means for attaching a pair of control rods to said release lever, each of which are adapted to move said release lever about one of said two axes, said attachment means being located at positions spaced laterally from the axis about which the respective control rod is adapted to move said release lever.

4. An assembly as set forth in claim 3 wherein said release lever support means includes a ball member and a ball seat member.

5. An assembly as set forth in claim 4 wherein said release lever support means includes limiting means for preventing motion of said release lever about more than two angularly related axes.

6. An assembly as set forth in claim 5 wherein said limiting means includes an elongated slot in one of said ball and seat members, and a pin in the other of said members extending into said slot.

7. An assembly as set forth in claim 5 wherein said limiting means includes a ball member supported by said release lever, a ball seat member on said support means, an elongated slot in said ball seat member and a pin in said ball member extending into said slot.

8. An assembly as set forth in claim 7 including a lock arm movable to a position to prevent movement of said release lever.

9. An assembly as set forth in claim 8 wherein said lock arm includes a body portion pivotally connected to said support means and a flange portion supported by said body portion at a position displaced from the pivot axis thereof, said flange portion extending generally in a direction parallel to the pivot axis of said body portion.

10. An assembly as set forth in claim 9 wherein said lock arm includes attachment means for attaching a lock control rod thereto.

11. An assembly as set forth in claim 9 wherein said latch means includes a pair of opposed latch arms.

12. An assembly as set forth in claim 11 wherein said support means includes a pair of latch pivot pins for pivotally supporting said latch arms, the longitudinal axes of said latch pivot pins being parallel and said latch pivot pins being longitudinally staggered and spaced laterally apart such that said latch arms are supported one above the other and relatively laterally spaced apart.

13. An assembly as set forth in claim 12 wherein said latch arms include first lever arms disposed on the adjacent ends of said latch arms, said lever arms including connecting means for connecting the same to said link means.

14. An assembly as set forth in claim 13 wherein said link means is disposed between said latch arms and includes a connecting pin extending from each side thereof toward said latch arms, said connecting means including openings in said lever arms for receiving and connecting pins.

15. An assembly as set forth in claim 13 wherein said latch arms include second lever arms and over-center spring means between said second lever arms and said support means for urging said latch arms toward one of said latched and unlatched positions.

16. An assembly as set forth in claim 1 wherein said release lever support means includes limiting means for preventing motion of said release lever about more than two angularly related axes.

17. An assembly as set forth in claim 16 wherein said limiting means includes a ball member supported by said release lever, a ball seat member on said support means, an elongated slot in said ball seat member and a pin in said ball member extending into said slot.

18. An assembly as set forth in claim 1 including a lock arm movable to a position to prevent movement of said release lever.

19. An assembly as set forth in claim 18 wherein said lock arm includes a body portion pivotally connected to said support means and a flange portion supported by said body portion at a position displaced from the pivot axis thereof, said flange portion extending generally in a direction parallel to the pivot axis of said body portion.

20. An assembly as set forth in claim 19 wherein said lock arm includes attachment means for attaching a lock control rod thereto.

21. A door latch assembly comprising: latch support means including at least one wall; means for attaching said latch support means to a door; a pair of opposed latch arms pivotally supported on a first side of said wall, one above the other and relatively laterally spaced apart; a movable link extending through an opening in said wall and connected to said latch arms for alternately pivoting said latch arms toward and away from one another; a release lever for actuating said link to pivot said latch arms away from one another; and release lever support means for movably supporting said release lever on the second side of said wall in engaging proximity to said link such that said release lever is movable about at least two angularly related axes whereby movement of said release lever about each said axis against said link moves said link through said wall causing said latch arms to pivot away from one another.

22. An assembly as set forth in claim 21 wherein said release lever includes first attachment means for attaching a control rod thereto to pivot said release lever about a first axis and second attachment means for attaching a control rod thereto to rotate said release lever about a second axis.

23. An assembly as set forth in claim 22 wherein said release lever support means includes means for preventing movement of said release lever about more than two angularly related axes.

24. An assembly as set forth in claim 23 wherein said release lever support means includes a ball member, a ball seat member, an elongated slot in one of said members, and a pin in the other of said members extending into said slot.

25. An assembly as set forth in claim 24 including a lock arm pivotally supported on the second side of said wall of said latch support means movable to a position to prevent movement of said release lever toward said link.

26. An assembly as set forth in claim 25 wherein said lock arm includes a body portion pivotally connected to said wall of said latch support means and a flange portion supported by said body portion at a position displaced from the pivot axis thereof, said flange portion extending generally in a direction parallel to the pivot axis of said body portion.

27. An assembly as set forth in claim 26 wherein said lock arm includes attachment means for attaching a lock control rod thereto.

28. An assembly as set forth in claim 27 including over-center spring means connected between said latch support means and said latch arms.

29. An assembly as set forth in claim 28 including a latch bar and means for attaching said latch bar to a door frame.

* * * * *